US005816688A

United States Patent [19]

Shui-Shang

[11] Patent Number: 5,816,688

[45] Date of Patent: Oct. 6, 1998

[54] MULTI-FUNCTIONAL LIGHTING APPARATUS

[76] Inventor: Chen Shui-Shang, P.O Box 55-175, Taichung, Taiwan

[21] Appl. No.: 717,343

[22] Filed: Sep. 20, 1996

[51] Int. Cl.[6] ..... F21V 33/00

[52] U.S. Cl. ..... 362/253; 362/187; 362/202; 362/205

[58] Field of Search ..... 362/186, 202, 362/253, 205, 187, 203, 204, 102, 109

[56] References Cited

U.S. PATENT DOCUMENTS

| | | | |
|---|---|---|---|
| 4,307,439 | 12/1981 | Sassmannshausen | 362/202 |
| 4,605,994 | 8/1986 | Krieg | 362/202 |
| 4,609,976 | 9/1986 | Geissler | 362/202 |
| 5,124,898 | 6/1992 | Chabria | 362/253 |
| 5,347,438 | 9/1994 | Lerner | 362/186 |
| 5,412,548 | 5/1995 | Yee | 362/202 |

*Primary Examiner*—James C. Yeung

[57] ABSTRACT

A multi-functional lighting apparatus is provided, the apparatus is generally comprised of a tubular body, a head portion and a rear portion. The tubular body has a first cylinder chamber at forward end containing a slidable receptacle therein and engaged with an elongate ring contact and incorporated with a bent L-shaped first tip contact and a slant second tip contact which is engageable with the first tip contact and the bulb. The head portion is composed of a transparent tubular housing defining a second cylinder chamber therein, a transparent glass abutting a parabolic reflector at a forward end and a red-colored transparent sleeve slidably attached to the outer periphery of the tubular housing, so that this lighting apparatus can be applied to be an ordinary flashlight when the bulb is shifted to a vertex of the parabolic reflector or an ordinary lamp when the bulb is shifted into the second cylinder chamber or a warning signal when the red-colored transparent sleeve is slid forward to cover the upper portion of the tubular housing. The lighting apparatus further has a whistle formed in a rear portion to be applied to a slert when an user is in danger.

5 Claims, 5 Drawing Sheets

MULTI-FUNCTIONAL LIGHTING APPARATUS

BACKGROUND OF THE INVENTION

The present invention relates to lighting apparatus and more particularly to a structurally improved lighting apparatus which is adaptable to be a flashlight, a lamp or a warning signal or a whistle.

Typical flashlight is generally composed of a tubular body for containing a certain number of batteries and for forming a receptacle, a tip contact and a ring contact at fore end thereof and a head portion including a trumpet housing, a transparent glass and a parabolic reflector. An incandescent bulb mounts to the receptacle positioned at the vertex of the parabolic reflector. When it is turned-on, the ray of light, after reflecting on the paraboloid will become parallel to each other so as to achieve a light convergent effect. A flashlight is advantageous to search things in darkness. But it is limited from to be adaptable to a lamp or utilized for other purposes.

SUMMARY OF THE PRESENT INVENTION

The present invention has a main object to provide a multi-functional lighting apparatus which has a slidable receptacle made incorporation with a transparent housing of a head portion so as to facilitate retreating the incandescent bulb from the vertex of a parabolic reflector for shifting a flashlight into an ordinary lamp.

Another object of the present invention is to provide a multi-functional lighting apparatus which has a transparent sleeve in red color slidably attached onto the transparent housing for slidably changing the lamp into a warning signal.

Still another object of the present invention is to provide a multi-functional lighting apparatus which has a whistle at a rear portion can be used as an alert in dangeous situation.

The present invention will become more fully understood by reference to the following detailed description thereof when read in conjunction with the attached drawings.

DETAILED DESCRIPTION OF THE PREFERRED EMBODIMENT

Figure 1:
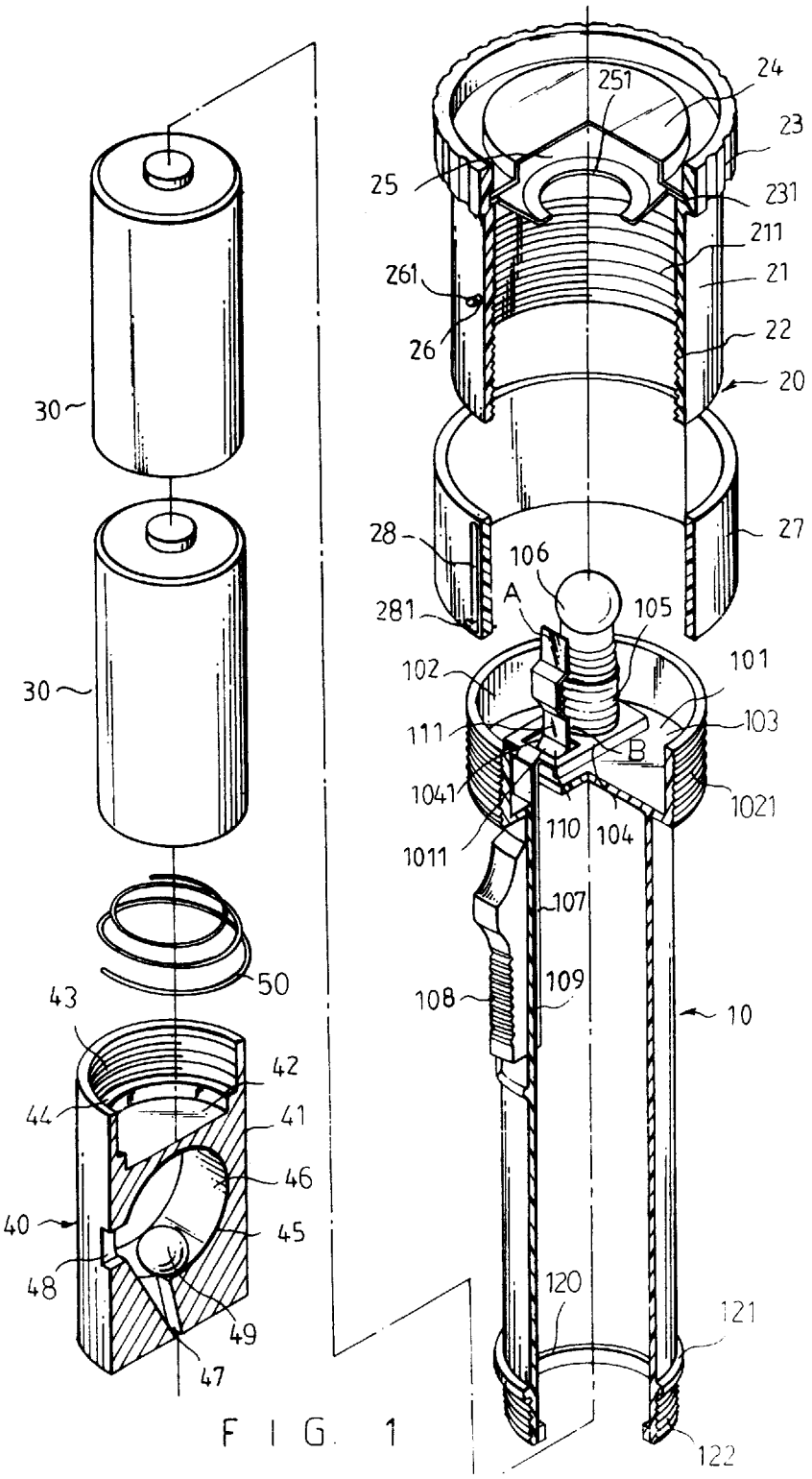
FIG. 1 is an exploded perspective view to show a multi-functional lighting apparatus of the preferred embodiment of the present invention.

With reference to the drawings and beginning with FIG. 1, the multi-functional lighting apparatus of the present invention comprises generally a tubular body 10, a head portion 20, a number of batteries 30 disposed into the tubular body 10 and a rear portion, wherein:

the tubular body 10 comprises a large diameter circular bottom 101 formed perpendicular to the forward end, an enclosure flange 102 including a threaded outer periphery 1021 projected upward from the circumference of the circular bottom 101 to define a first cylinder chamber 103 therein, a roughly L-shaped first tip contact 110 which has a transverse portion abutting the center of the inner surface of the bottom 101 where is engageable with the positive pole of the battery 30 and a bent vertical portion 111 projected upward through a first rectangular recess 1011 in a radial line of the bottom 101, a conductive rectangular receptacle 104 including a socket 105 centrally projected upward from an upper surface for mounting an incandescent bulb 106 therein, a second rectangular recess 1041 adjacent an outward end and aligned with the first rectangular recess 1011 for permitting the bent vertical portion 111 of the first tip contact 110 to passing through and an elongate conductive plate 107 perpendicularly connected to the outward end of the rectangular receptacle 104. The elongate conductive plate 107 engages with a slidable button 108 by means of the rivets 1071 so as to be moved in concert with the button 108. An elongate ring contact 109 axially disposed along an inner periphery of the tubular body 10 between the button 108 and the conductive plate 107 having one end exposed out of the bottom 101 and the other end connected to a conductive annular ring 120 inside the rear end of the tubular body 10 which is engageable with the negative pole of the battery 30, and a longitudinal guide slot 112 centrally formed through an upper portion for slidably receiving the rivets 1071 therein. A second tip contact 113 slantly disposes to the under side of the rectangular receptacle 104 having one end engageable with the tip of the bulb 106 and the other end slightly protrudent into the second rectangular recess 1041 so as to be alternately engageable with a first and a second introversion contact points A and B on the bent vertical portion 111 of the L-shaped first tip contact 110. The rear end of the tubular body 10 further has a engaging flange 121 and thread 122 formed around an outer periphery.

The head portion 20 comprises a transparent tubular housing 21 including threaded inner periphery 22 on lower portion made in registry with the threaded outer periphery 1021 of the enclosure flange 102 so as to be mounted to the flange 102, a second cylinder chamber 211 defined in the housing 21, a spline flange 23 extended outward from upper rim having an annular groove 231 formed in the inner periphery for securing a transparent glass 24 and a parabolic reflector 25 which has a central recess 251 formed at the vertex of the parabola for entering and locating the bulb 106 therefrom. The tubular housing 21 further has a retaining pin 26 projected outward from an outer periphery for slidably retaining a red-colored transparent annular sleeve 27 thereon. The pin 26 engages into a roughly L-shaped slot 28 in the sleeve 27 including a large diameter dome head 261 that retains the sleeve 27 which is made of flexible material and has a inner diameter equal to the outer diameter of the tubular housing 21 and a height as half height of the housing 21 so that the sleeve 27 will be stably attached to the housing 21 and normally positioned at a lower portion of the housing 21. The slot 28 has a transverse portion 281 abutting the lower end for temporarily retaining the sleeve 27 by the retaining pin 26 when it slides upward and covers the upper portion of the housing 21.

The rear portion 40 comprises a cylinder body 41, a circular cavity 42 including a threaded inner periphery 43 made in registry with the threaded outer periphery 122 at the rear end of the tubular body 10 so as to be engaged with the rear end and a less diameter annular projection 44 around the bottom of the cavity 42 for receiving a spring 50 therein, and a whistle 45 formed in the lower portion which has a spherical chamber 46, an air ingress 47, an air egress 48 and a small ball 49 movably disposed inside the chamber 46. When blows from ingress 47, it gives a sound of whistle from the egress 48.

Figure 2A:
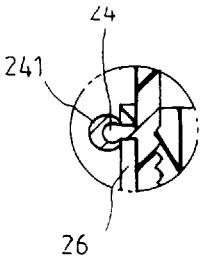
FIGS. 2 and 2A are the sectional views to show an assembled multi-functional lighting apparatus of the present invention.
Figure 2:
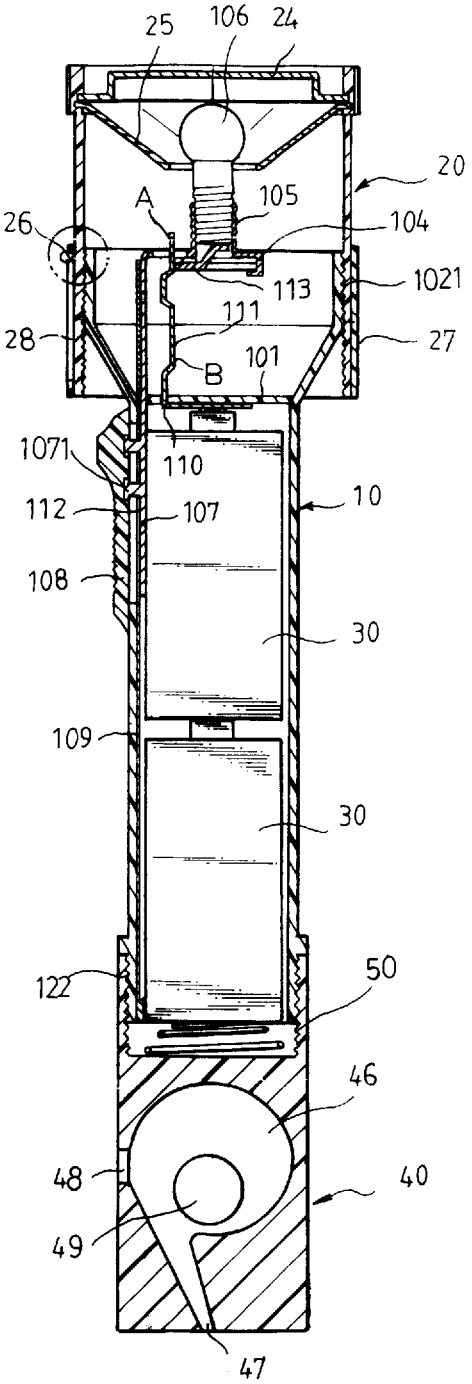
Figure 3:
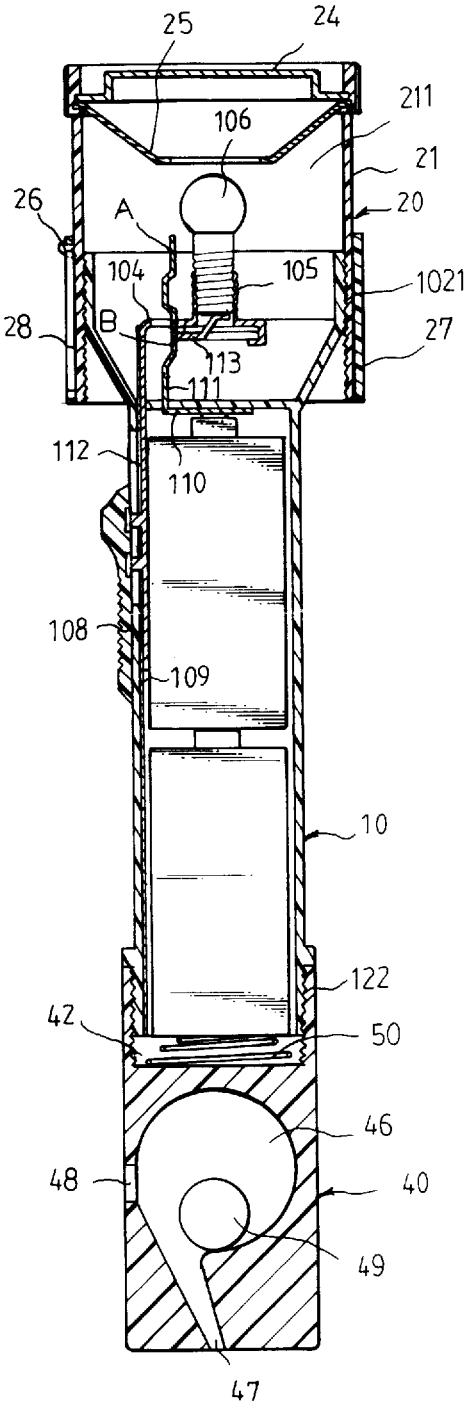
FIG. 3 is a sectional view of FIG. 2 when the receptacle is retreated inward from the parabolic reflector.

Referring to FIGS. 2, 2A and 3, the multi-functional lighting apparatus is assembled when engages the head portion 20 and the rear portion 40 with two ends of the tubular body 10 respectively. FIG. 2 shows that the spring 50 biases between the negative pole of the battery 30 and the cavity 42 and that the button 108 is slid to its forward terminal where the bulb 106 is ascended and positioned in place at a vertex of the paraboloid of the reflector 25 and the first contact point A of the bent vertical portion 111 of the L-shaped first tip contact 110 engages with the second tip contact 113. Because the elongate conductive plate 107 of the rectangular receptacle 104 normally engages with the elongate ring contact 109. So that the bulb 106 is therefore lighted and the multi-functional lighting apparatus of the present invention is now applied as an ordinary flashlight. Occasionally, if a power failure happens in a house, slides the button 108 backwardly to a rearward terminal as shown in FIG. 3, so that the bulb 106 is retreated from the reflector 25 and stops in the second cylinder chamber 211 and that the second contact point B of the first tip contact 110 is now engages with the second tip contactor 113. So that the bulb 106 is lighted again in the transparent tubular housing 21 and the multi-functional lighting apparatus is now applied as a lamp in a house or used as a lighting apparatus at an outdoor camping in night time.

Figure 4:
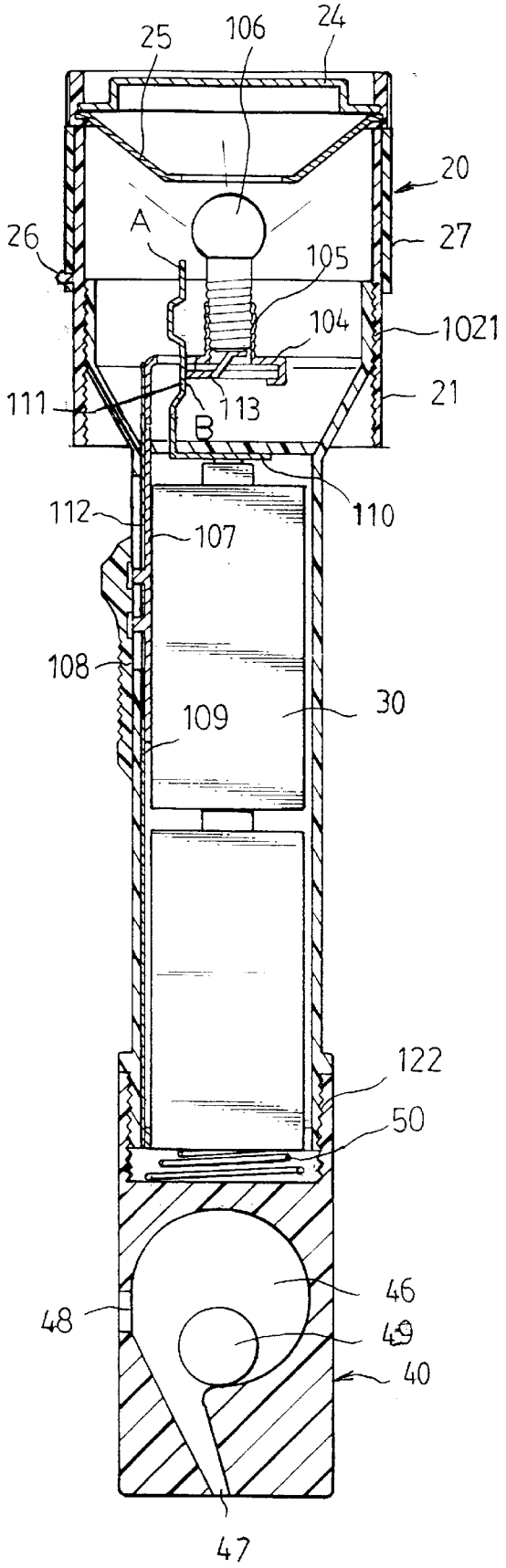
FIG. 4 is a sectional view to show a red colored transparent sleeve sliding forward and sleeved onto the outer periphery of the transparent housing.

When a traffic accident or a bug is occurred in a suburban area, a driver can wave this lighting apparatus as a warning signal after sliding it's red-colored transparent sleeve 27 forward and completely covering the outer periphery of the transparent tubular housing 21 (as shown in FIG. 4) and then swinging it counterclockwise so that the transverse portion 281 of the L-shaped slot 28 is retained by the retaining pin 26. Further, if the user wants to turn-out of the light, shift the button 108 to a medial position so that the bent vertical portion 111 of the L-shaped first tip contact 110 will disengage with the second tip contact 113.

Figure 5:
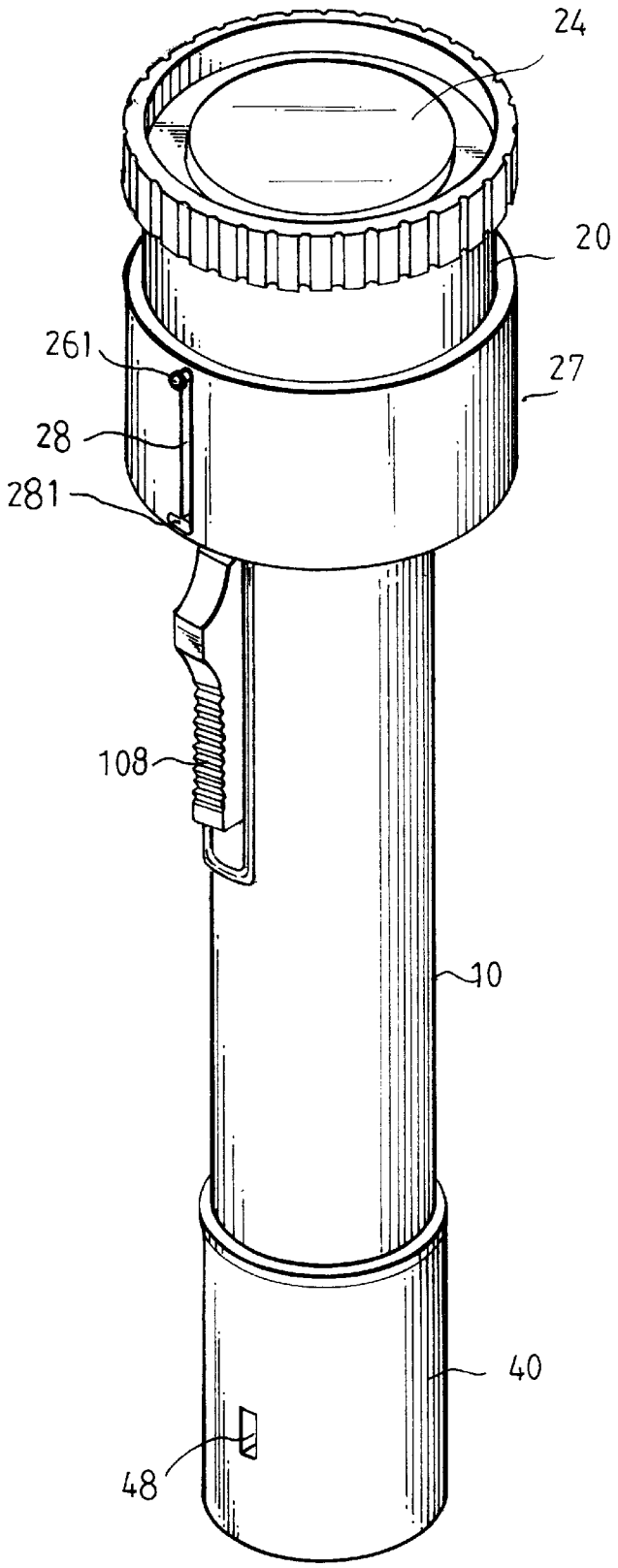
FIG. 5 is a perspective view to show an outer appearance of the multi-functional lighting apparatus according to the present invention.

If the user subjects to a danger such as to be attacked by an intruder, he blows the air ingress 47 of the whistle 45 in the rear portion 40 of the lighting apparatus, a sound of whistle is provided to alert the people nearby seeking for help. FIG. 5 shows an outer appearence of a multi-functional lighting apparatus of the present invention.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. An apparatus for lightening or warning purpose comprising generally a tubular body containing a plurality of batteries therein, a head portion and a rear portion, wherein:

said tubular body comprising a large diameter bottom at forward end having an enclosure flange projected upward from circumferential edge thereof including a threaded outer periphery and defining a first cylinder chamber therein, a first rectangular recess through said bottom and at a radial line thereof for passing through a first tip contact plate which has a roughly L-shaped section including a transverse portion centrally attached to an inner surface of said bottom engageable with a positive pole of the battery and a bent vertical portion projected forward from the first rectangular recess including a first and a second introversary contact points thereon; a rectangular receptacle member movably disposed in the first cylinder chamber and parallel to said bottom having a socket centrally projected forward from a top for axially mounting an incandescent bulb therein, a second rectangular recess formed adjacent an outward end and aligned with the first rectangular recess for permitting the bent vertical portion of said L-shaped first tip contact plate passing through therefrom and an elongate conductive plate integrally formed perpendicular to the outward end thereof and extended rearward along an inner periphery of said tubular body and connected by a pair of rivets to a slidable button on an outward periphery of said tubular body, a second tip contact plate slantly secured to an under side of said receptacle having one end engageable with the tip of said incandescent bulb and other end exceeded into the second rectangular recess so as to be engageable with the first and second contact point of said first tip contact plate, an elongate ring contact plate axially secured to an inner periphery of said tubular body between said elongate conductive plate and said button and extended along the length thereof having a longitudinal guide slot formed in upper portion for slidably receiving the rivets thereabout, a forward end slightly extended forward from said bottom and a rear end perpendicularly connected to an annular ring which secures to an inner periphery of the rear end of said tubular body, and an annular flange abutting a threaded outer periphery of said tubular body;

said head portion engaged with said enclosure flange of said tubular body and comprising a transparent tubular housing defining a second cylinder chamber in an upper portion, a threaded inner periphery on a lower inner periphery made in registry with the threaded outer periphery of said enclosure flange, a splined annular flange means formed at forward edge including an annular groove in an inner periphery for securing a transparent glass and a paraboloid reflector therein, said relfector having a central recess formed at a vertex of the paraboloid for receiving said bulb when said button is slid to a forward terminal, said tubular housing further comprising a retaining pin including a large diameter circular head for slidably retaining a red-colored transparent sleeve member thereon, said sleeve member having an annular body of a height equal to half height of said tubular housing and of an inner diameter equal to an outer diameter thereof so as to be closely attached to lower portion of said housing and to be slidable to the upper portion of said housing and temporaily retained hereto by said retaining pin, said sleeve further having a L-shaped slot longitudinally formed in a periphery and extended along the height thereof including a transverse portion retainable by said retaining pin;

said rear portion covered the rear end of said tubular body, said rear portion comprising a cylinder body, a less diameter circular cavity axially formed in a forward end including a threaded inner periphery made in registry with the threaded outer periphery on the rear end of said tubular body so as to be engageable therewith and an annular protrusion on the bottom of said cavity for biasing a spring means therein and a whistle formed inside said cylinder body beneath said cavity and having a spherical chamber with an air ingress in a rearward end and an air egress in a peripheral wall of said rear portion and a small ball movably disposed into said spherical chamber;

when said lighting apparatus is assembled, said spring means is biased against a negative pole of said battery and said incandescent bulb stops at a vertex of paraboloid of said relfector so that said lighting apparatus is applied as an ordinary flashlight.

2. An apparatus as recited in claim 1 wherein said red-colored transparent sleeve is made from flexible material.

3. An apparatus as recited in claim 1 wherein said lighting apparatus can be applied to be an ordinary lamp when said button slides to a rearward terminal.

4. An apparatus as recited in claim 1 wherein said lighting apparatus can be applied to be a waving signal in an accident when slides said red-colored transparent sleeve forward to cover an upper portion of said transparent tubular housing.

5. An apparatus as recited in claim 1 wherein said lighting a apparatus can be applied to be a whistle to alert people when an user is in danger.

* * * * *